US008454353B2

(12) United States Patent
Winklhofer

(10) Patent No.: US 8,454,353 B2
(45) Date of Patent: Jun. 4, 2013

(54) METHOD FOR EVALUATING THE STATE OF A FUEL/AIR MIXTURE

(75) Inventor: Ernst Winklhofer, St. Johann OB Hohenburg 1 (AT)

(73) Assignee: AVL List GmbH, Graz (AT)

( * ) Notice: Subject to any disclaimer, the term of this patent is extended or adjusted under 35 U.S.C. 154(b) by 1384 days.

(21) Appl. No.: 12/153,713

(22) Filed: May 22, 2008

(65) Prior Publication Data

US 2008/0299505 A1 Dec. 4, 2008

(30) Foreign Application Priority Data

May 31, 2007 (AT) ..... A 859/2007

(51) Int. Cl.
*F23N 5/08* (2006.01)

(52) U.S. Cl.
USPC ..... 431/79; 431/126; 431/354; 431/115; 431/183; 123/295; 123/436; 123/525; 123/526; 123/575; 356/315; 356/417

(58) Field of Classification Search
USPC ..... 431/79, 126, 354, 115, 183; 123/295, 123/436; 356/315
See application file for complete search history.

(56) References Cited

U.S. PATENT DOCUMENTS 3,978,720 A 9/1976 Ford
5,659,133 A 8/1997 Sims
6,045,353 A * 4/2000 VonDrasek et al. ..... 431/79
6,560,526 B1 * 5/2003 Matekunas et al. ..... 701/104
2001/0039473 A1 * 11/2001 Takaku et al. ..... 701/114

FOREIGN PATENT DOCUMENTS

| | | |
|---|---|---|
| EP | 0412578 | 2/1991 |
| FR | 2816056 | 5/2002 |
| JP | 2005-226893 | 8/2005 |
| WO | 9731251 | 8/1997 |

OTHER PUBLICATIONS

English Abstract of JP63105262, May 10, 1988.
English Abstract of FR2816056, May 3, 2002.
English Abstract of JP2005226893, Feb. 12, 2004.

* cited by examiner

*Primary Examiner* — Avinash Savani
(74) *Attorney, Agent, or Firm* — Dykema Gossett PLLC

(57) ABSTRACT

The invention relates to a method for evaluating the state of a fuel/air mixture and/or the combustion in a combustion chamber of an internal combustion engine, with sample signals of flame light signals, preferably the flame intensity ($F_I$), with associated mixture states being saved to a database, with flame light signals, preferably the flame light intensity ($F_I$), of the combustion in the combustion chamber being detected and thus being compared with the saved sample signals, and with conclusions being drawn on the state of the mixture in the combustion chamber in the case of coincidence between measured and saved signal patterns. In order to enable a simple and precise monitoring of the mixture state and the combustion it is provided that a pressure measurement is also performed in the cylinder simultaneously with the detection of the flame light signals.

14 Claims, 2 Drawing Sheets

METHOD FOR EVALUATING THE STATE OF A FUEL/AIR MIXTURE

BACKGROUND OF THE INVENTION

1. Field of the Invention

The invention relates to a method for evaluating the state of a fuel/air mixture and/or the combustion in a combustion chamber of an internal combustion engine, with sample signals of flame light signals, preferably the flame intensity, with associated mixture states being saved to a database, with flame light signals, preferably the flame light intensity, of the combustion in the combustion chamber being detected and thus being compared with the saved sample signals, and with conclusions being drawn on the state of the mixture in the combustion chamber in the case of coincidence between measured and saved signal patterns.

2. The Prior Art

The development of spark-ignition internal combustion engines and the calibration of engine actuators is subject to precise knowledge of cylinder- and cycle-specific emissions and exhaust gas temperatures. During driving operation, alternating high-load and partial-load sequences can cause reactive gas to flow into the catalytic converter, leading to overheating and finally to damage to the catalytic converter.

When the engine is started and in the case of stationary and especially also transient driving operation, it may occur as a result of delayed evaporation processes and storage effects that the fuel/air mixture is not sufficiently prepared and thus increased emissions, irregular combustion processes or misfiring will occur. The recognition and correction of such operating states is the precondition for low-emission and secure engine operation.

It is therefore important to determine the state of the mixture within the combustion chamber at an early point and to diagnose the cause of increased portions of reactive gas components.

A combustion detector for internal combustion engines is known from U.S. Pat. No. 3,978,720 A, with the flame radiation in the visible and/or infrared range being measured within the cylinder by means of a quartz window in the cylinder wall or in the cylinder head. The detection of the radiation is used for controlling the ignition point or for detecting the speed or misfiring.

WO 97/31251 discloses a fiber-optic pressure sensor for detecting knocking and misfiring in an internal combustion engine. Optical pressure sensors are integrated in a spark plug.

U.S. Pat. No. 5,659,133 A describes an optical high-temperature sensor for the combustion chamber of an internal combustion engine with which variables can be provided for feedback control of the combustion chamber. The optical signals are processed in a transducer in order to detect in real time events such as ignition sparks, start and end of combustion, backfiring and knocking phenomena. The obtained information is used for feedback control of the roughness of the engine and cycle stability. Moreover, statements can be made on combustion temperature and generated emissions through specific flame colours.

EP 0 412 578 A2 discloses a method for recognizing knocking in an internal combustion engine by means of optical combustion sensors associated with the combustion chamber. The flame intensity of the combustion or combustion temperature within the cylinder is measured with the combustion sensors. In the method for recognizing knocking, the combustion light in the respective combustion chambers is detected, with the signals being compared with a defined threshold value. A knocking phenomenon is recognized as such when the signal level provided by the optical sensor lies beneath the threshold value.

JP 63-105262 A further discloses a method for controlling the air/fuel ratio in the internal combustion engine, with the flame light in a combustion chamber being detected by an optical sensor and the fuel quantity supplied to a carburettor being regulated depending on the detected measured value of the optical sensor as corresponds to the air/fuel ratio.

From the specifications FR 2 816 056 A1 and JP 2005-226893 A, a method is known from each for evaluating the state of a combustible mixture, with flame light signals measured during the combustion being compared with sample signals saved to a database and conclusions being drawn on the state of the mixture in the combustion chamber in the case of coincidence between measured and saved signal patterns. In certain cases, the state of the combustible mixture cannot be evaluated precisely enough.

It is the object of the invention to enable a precise monitoring of the mixture state and combustion in a simple way in an internal combustion engine.

SUMMARY OF THE INVENTION

This is achieved in accordance with the invention in such a way that a pressure measurement is performed in the cylinder simultaneously with the detection of the flame light signals.

The sample signals can be recorded by measurements under known operating and emission conditions or can be derived from theoretical considerations in respect of mixture forming and combustion. It is also possible however that sample signals are generated from computational linking of flame light signals and cylinder pressure signals or signals derived therefrom, such as the progression of release of heat for example.

It is further advantageous when a time signal, preferably a crank angle signal, is detected and the flame light signal is associated with the time signal. This ensures that it is possible to draw conclusions about the mixture state, ignition point, start and end of combustion, misfiring and knocking phenomena as well as the type of combustion from the position and progression of the flame light signal.

By comparing the detected flame light signals with the sample signals stored in a database, a direct statement on the mixture state can be made. The simultaneous pressure measurement that is true to the cycle increases the precision and reliability on the statement quality and thus leads to a refining of the measuring process. The combined evaluation of the cylinder pressure and the flame light leads to a higher precision and accuracy when making statements on the mixture state of the air/fuel mixture.

It is advantageous when the cylinder pressure peaks are compared with the flame light signal peaks within at least one cycle, through which it is possible to draw conclusions on irregular combustion from a deviation between the cylinder pressure peaks and the light signal peaks, especially in the case of transient engine operations.

As a result of the measuring results, an optimization procedure for the parameterization of the injection and/or air throttling can subsequently be started on the basis of the results of the measurement.

An important advantage of the method in accordance with the invention is that the information is present true to cycle for each cylinder. This allows an especially precise feedback control of the combustion in real time, thus enabling a further substantial improvement in the exhaust gas emissions.

In order to enable making statements beyond the engine, it is advantageous when dimensionless parameters are formed on the basis of the flame light signals and/or pressure measurement signals and the parameters are used as a basis for evaluating the mixture state and/or the combustion.

The invention is now explained in closer detail by reference to the drawings.

DETAILED DESCRIPTION OF THE PREFERRED EMBODIMENT

The flame intensity is measured in at least one combustion chamber of a spark-ignition internal combustion engine by means of an optical sensor and a signal is detected at the same time, e.g. a crank angle signal for time allocation. Rough statements can already be made from the position and the course of the flame intensity curve $F_I$ on whether there is a homogeneous or heterogeneous combustion. Furthermore, the flame intensity curve $F_I$ allocated to a time signal provided information on the phase position and on the presence of irregular or regular combustion. This information already provides a valuable guideline for rough calibration of the fuel injection, air throttling or ignition. However, the meaningfulness and precision is increased even more by a simultaneous measurement of the cylinder pressure signal. In order to enable a more detailed and precise evaluation, the cylinder pressure p is measured in addition to the flame intensity $F_I$. By comparing the flame intensity $F_I$ and the cylinder pressure p, entered over the crank angle KW, a refining of the measuring method can be achieved.

Figure 1:
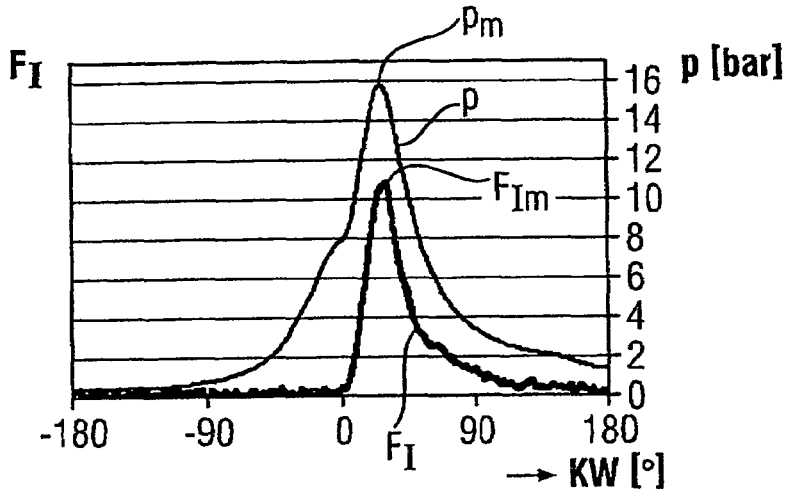
FIG. 1 shows a diagram for cylinder pressure and flame intensity over the crank angle for the combustion of a homogeneously premixed charge (premix combustion)
Figure 2:
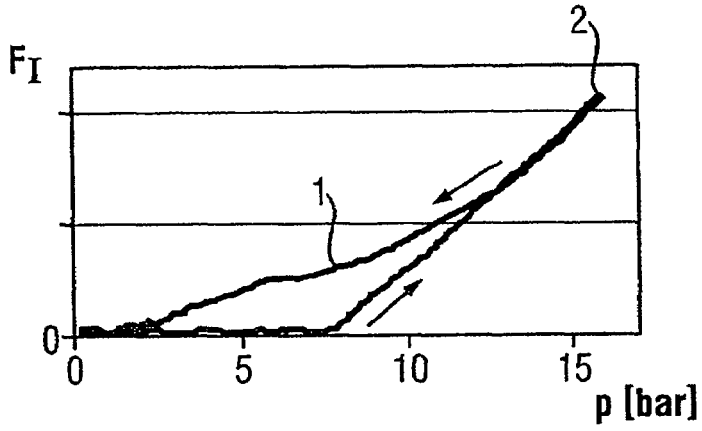
FIG. 2 shows a flame intensity/pressure diagram for premix combustion.

FIG. 1 shows in connection with this the flame intensity $F_I$ and the cylinder pressure p, entered over the crank angle KW. In the case of homogeneous combustion, the flame intensity $F_I$ proceeds synchronously to the cylinder pressure p or to the heating progression. The maximum values $F_{Im}$, $p_m$ of the flame intensity $F_I$ and the cylinder pressure p lie at the same crank angle KW. In the flame intensity $F_I$/cylinder pressure p diagram as shown in FIG. 2, curve 1 extends with no hysteresis or very little thereof, with the curve 1 having a single marked maximum value 2 for the flame intensity $F_I$ and the cylinder pressure p. The cylinder pressure p rises during the compression phase. After ignition the flame intensity $F_I$ also rises. Both signals simultaneously reach a maximum upon combustion of premixed charge and decrease again simultaneously with low hysteresis. The arrows show the direction of passage of the signal loop.

Figure 3:
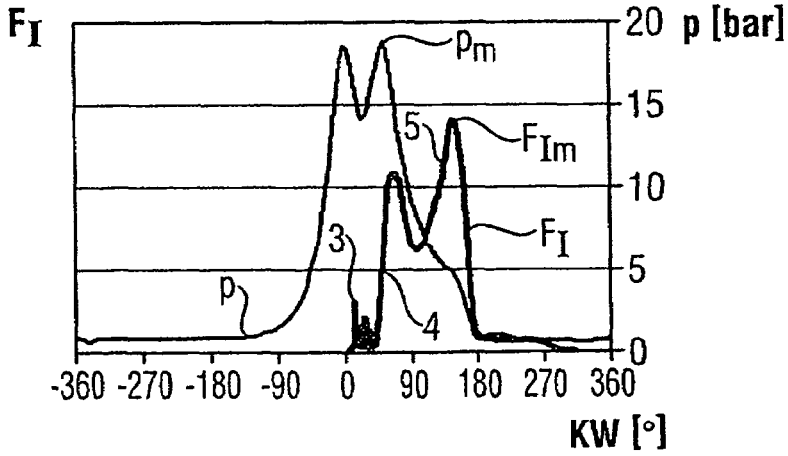
FIG. 3 shows a diagram for cylinder pressure and flame intensity over the crank angle for the combustion of heterogeneous charge (heterogeneous combustion)
Figure 4:
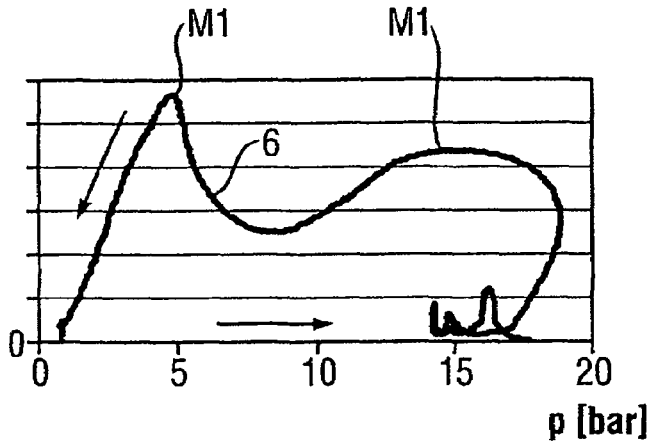
FIG. 4 shows a flame intensity/cylinder pressure diagram for heterogeneous combustion.

FIG. 3 shows a measurement example for heterogeneous combustion. It can clearly be seen that the measuring curves for flame intensity $F_I$ and cylinder pressure p are phase-shifted and the maximum values for flame intensity $F_{Im}$ and the cylinder pressure $p_m$ are clearly different in respect of time. The flame intensity curve $F_I$ clearly shows the ignition point 3, a partly homogeneous combustion 4 and a late diffusion combustion 5. A flame intensity $F_I$/cylinder pressure p diagram as shown in FIG. 4 shows that the maximum values for flame intensity $F_I$ and the cylinder pressure p do not coincide on curve 6 and that a distinct hysteresis is formed. The cylinder pressure p rises during compression.

The formation of flame core occurs during decreasing cylinder pressure p. Cylinder pressure p will only rise by combustion. In this process, flame intensity $F_I$ reaches a first maximum M1. A second maximum M2 is achieved at the end of the expansion by combustion of rich mixture zones. The arrows show the direction of passage of the signal loop.

Figure 5:
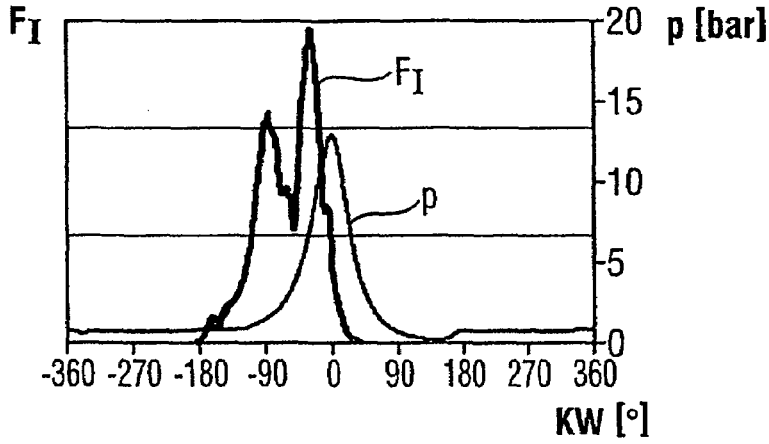
FIG. 5 shows a diagram for cylinder pressure and flame intensity over the crank angle for the combustion after an uncontrolled advanced ignition (combustion after irregular combustion)
Figure 6:
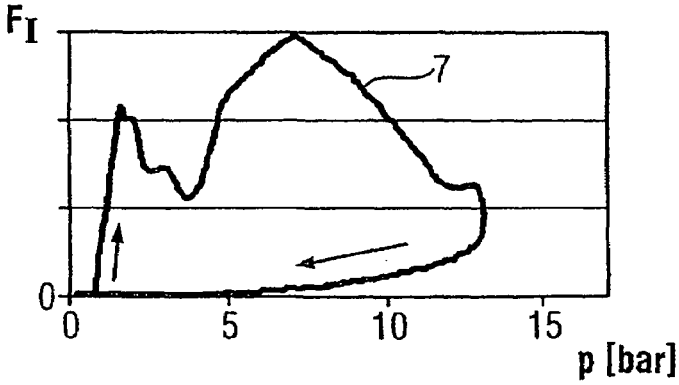
FIG. 6 shows a flame intensity/cylinder pressure diagram after irregular ignition.

FIG. 5 shows a measurement example for combustion during uncontrolled ignition advance. Ignition occurs by heating processes (not described here in closer detail) already during the early compression phase at low cylinder pressure p. The progression of the flame intensity signal shows that the combustion mainly occurs prior to the upper dead center of the compression. Pressure development beyond the extent of compression cannot be seen. In the flame intensity $F_I$/cylinder pressure p diagram as shown in FIG. 6, the rise of flame intensity $F_I$ occurs clearly earlier than the rise in pressure. The signal loop is run through in reverse sequence as compared with regular combustion. Combustion starts by an uncontrolled (irregular) ignition advance at low pressure. At first, flame intensity $F_I$ rises. Pressure increase occurs only after this. The signal loop 7 is run through in reverse sequence as compared with regular ignition. This is supported by the directions of the arrows. In this case too, the maximums of flame intensity $F_I$ and cylinder pressure do not coincide.

It is especially advantageous when the flame intensity $F_I$ and the cylinder pressure p are normalized to the respective signal maximum ($F_{Imax}$=100% and $p_{max}$=100%) and are shown as dimensionless parameters. Internal combustion engines of different size and type can thus be compared with each other. In particular, an engine-independent evaluation for feedback control of the injection point, the injection quantity, the air throttling or the ignition point is possible.

An especially high precision can be achieved when cylinder pressure p and flame intensity $F_I$ are measured at the same location, preferably by the same component. This measuring location should lie as close as possible to the ignition place. An especially high precision with the described method can be achieved by using a sensor spark plug in which both an optical sensor as well as a pressure sensor is integrated.

The invention claimed is:

1. A method for evaluating a state of a fuel/air mixture and/or a combustion in a combustion chamber of an internal combustion engine, comprising the steps of:

saving sample flame light signals with associated mixture states to a database, wherein the flame light signals are diffusion flame light signals and/or premixed flame light signals;

detecting flame light signals of combustion in a combustion chamber;

comparing the detected flame light signals with the saved sample signals;

drawing conclusions on the state of the mixture in the combustion chamber in the case of coincidence between patterns of measured and saved light signals, and performing a pressure measurement in a cylinder simultaneously with a detection of the flame light signals.

2. The method according to claim 1, wherein sample signals are recorded from measurements under known operating and emission conditions.

3. The method according to claim 1, wherein sample signals are derived from theoretical considerations on mixture formation and combustion.

4. The method according to claim 1, wherein sample signals are generated from computational linking of flame light signals and cylinder pressure signals or signals derived therefrom.

5. The method according to claim 1, wherein a time signal is detected and the flame light signals are allocated to the time signal.

6. The method according to claim 1, wherein conclusions are drawn on the mixture state, ignition point, start and end of combustion, misfirings and knocking phenomena as well as the type of combustion from the position and progression of the flame light signal.

7. The method according to claim 1, wherein peaks of the cylinder pressure are compared with peaks of the flame light signal at least within one cycle.

8. The method according to claim 7, wherein conclusions are drawn on irregular combustionfrom a deviation between the cylinder pressure peaks and the light signal peaks.

9. The method according to claim 1, wherein an optimization procedure for a parameterization of the injection and/or an air throttling is performed depending on the mixture state and/or a deviation between the cylinder pressure peaks from the light signal peaks.

10. The method according to claim 1, wherein dimensionless parameters are formed on a basis of the flame light signals and/or the pressure measurement signals and the parameters are used as a basis for evaluating the mixture state and/or the combustion.

11. The method according to claim 4, wherein sample signals are generated from the progression of release of heat.

12. The method according to claim 5, wherein the time signal is a crank angle signal.

13. The method of claim 8, wherein the conclusions are drawn on irregular combustion during transient engine operations.

14. The method of claim 1, wherein flame intensity is used as flame light signals.

* * * * *